US005330179A

United States Patent [19]

Hampel

[11] Patent Number: 5,330,179

[45] Date of Patent: Jul. 19, 1994

[54] GOLFER'S PUTTING AID

[76] Inventor: Frederick E. Hampel, Rte. 2, Box 2290, Old Reed Creek Rd., Hartwell, Ga. 30643

[21] Appl. No.: 17,301

[22] Filed: Feb. 12, 1993

[51] Int. Cl.[5] ..... A63B 57/00

[52] U.S. Cl. ..... 273/32 H; 33/379; 33/369

[58] Field of Search ..... 273/32 H, 32 R, 32 B, 273/187.6; 33/508, 365, 370, 369, 374, 375, 379

[56] References Cited

U.S. PATENT DOCUMENTS 3,293,755 12/1966 Cronwell ..... 273/32 H X
3,535,792 10/1970 Douglas ..... 273/32 H X
3,908,991 9/1975 Schwartz ..... 273/32 H
4,082,286 4/1978 La Breche ..... 273/32 H X

*Primary Examiner*—George J. Marlo
*Attorney, Agent, or Firm*—Cort Flint; Henry Jaudon

[57] ABSTRACT

A gauge for determining the distance of break, on a surface of golf green for a properly putted golf ball moving from a given point toward a golf cup. The gauge includes a base having measure indica at each end thereof and a level indicating member on one edge thereof. A sighting element is pivotally secured with the base and includes measure indica pointing means at each end thereof. By selecting a given point from the golf cup and arranging the base so that the level indicating member indicates level and arranging the sighting element to be coplanar with the surface of the golf green at the golf cup, the indica pointing means will point to measure indica denoting the distance of break of the golf ball to the left or right of the cup.

7 Claims, 2 Drawing Sheets

GOLFER'S PUTTING AID

BACKGROUND OF THE INVENTION

The invention is directed to a gauge which is operative to assist golfers to determine the amount of break a properly putted golf ball will have between a given point on the surface of the green and the cup.

The surfaces of golf greens are contoured to be at various angles or to have numerous slopes of varying degree. Because of these contours, the golf ball seldom rolls along a straight line. In order for a golfer to putt the ball into the golf cup he must first determine the break or the distance the golf ball will move from a straight lint of trajectory during its movement toward the golf cup. Failure to properly make this determination results in a missed putt and is the most frustrating thing facing the week end golfer. The invention is intended to relieve that frustration by assisting the golfer in determining the distance of break.

Accordingly, it is an object of the invention to provide an assisting tool for putting a golf ball.

A further object of the invention is to provide a mechanism to determine the distance of break of a properly putted golf ball.

SUMMARY OF THE INVENTION

A putting gauge for determining the distance of break of a putted golf ball when putted from a given point on the surface of the golf green toward the golf cup at a proper speed. The gauge includes a base member with measure indica thereon and a level indicating element.

A sighting element is pivotally mounted with the base member. The sighting element includes a sighting edge and pointing means.

To operate the gauge, the base member is held in a proper position relative to true vertical and the sighting element is arranged in a proper position relative to the golf green surface. With the base member and the sighting element retained in this position, the pointing means denote the distance a properly putted golf ball will break between said given point and the golf cup.

The base is substantially rectangular and includes an upper edge, a lower edge and opposed ends. The measure indica is arranged adjacent the opposed ends of the base. The level indicating element is secured along the lower edge of the base. An intermediate portion of the upper edge of the base member is arranged below the outer extremes thereof and extends along a single plane.

The measure indicia is arranged in spaced segments along opposed edges of the base. Each segment of the spaced indicia is correlated for a different distance from the golf cup. The spaced segments adjacent the left end of the base indicate the distance of break of the golf ball to the right and the spaced segments adjacent the right end of the base indicate the distance of break of the golf ball to the left.

The sighting element includes opposed ends, and is pivotally mounted with the base member at a point intermediate its ends and the opposed ends of the base. Pointing means are carried by the opposed ends of the sighting element.

The pointing means are arranged as a plurality of opposed pairs of pointing elements which are arranged along opposite ends of the sighting element. Each pair of the opposed pairs of pointing elements are correlated for a different distance from the golf cup. Normally there are four opposed pairs of pointing elements with the first of these opposed pairs of pointing elements being correlated for a distance of five feet between a point and the golf cup. Each successive pair of opposed pairs of pointing elements are correlated for a greater distance.

The pointing elements arranged on the left end of the sighting element are operative to determine the break of the putted golf ball to the right and the pointing elements arranged on a right end of the sighting element are operative to determine the break of the putted golf ball to the left.

A method for determining the distance of break, on a surface of golf green, for a properly putted golf ball moving from a given point toward a golf cup. The method includes providing a putting gauge having a base on which measure indica is provided and which carries a level indicating member. Providing a sighting element having measure indica indicating means and pivotally securing the sighting element with the base.

Selecting the given point at a distance from the golf cup and arranging the base so that the level indicating member of the base indicates level. Arranging the sighting element to be coplanar with the surface of the golf green at the golf cup without disturbing the position of the base. Reading the measure indica pointed to by the indicating means.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

While a preferred embodiment of the invention has been described using specific terms, such description is for illustrative purposes only, and it is to be understood that changes and variations may be made without departing from the spirit or scope of the invention.

Figure 1:
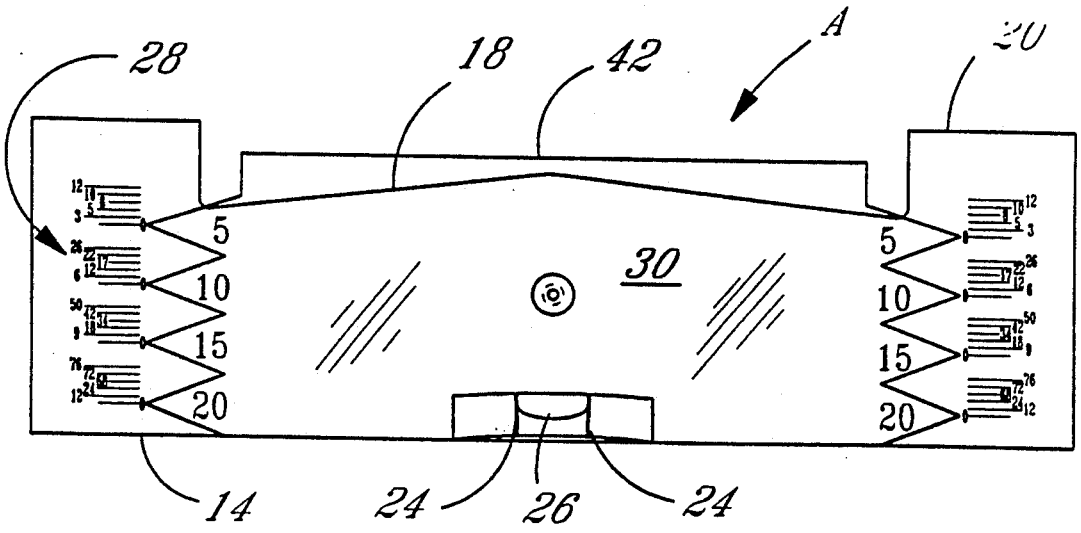
FIG. 1 is a side view of the gauge of the invention.
Figure 2:
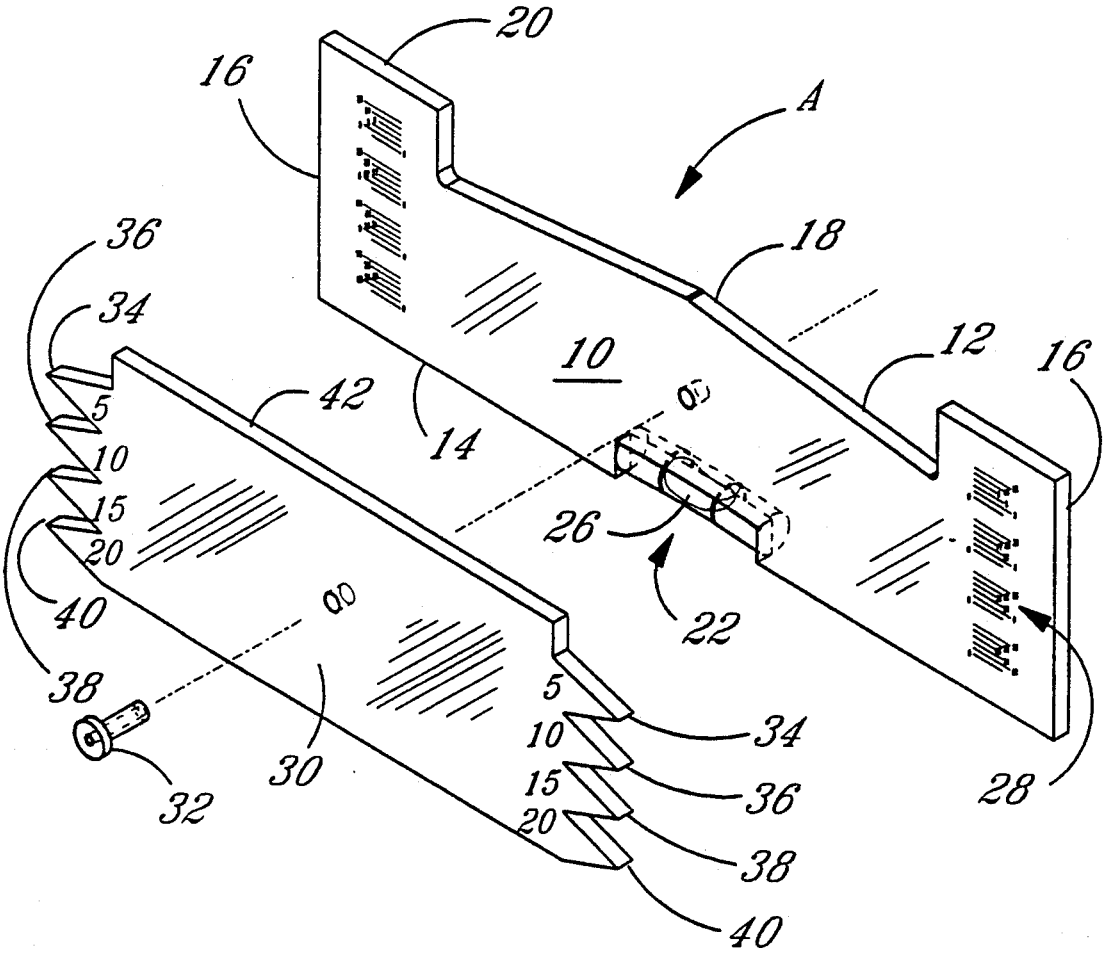
FIG. 2 is an exploded perspective view of the gauge of the invention.
Figure 3:
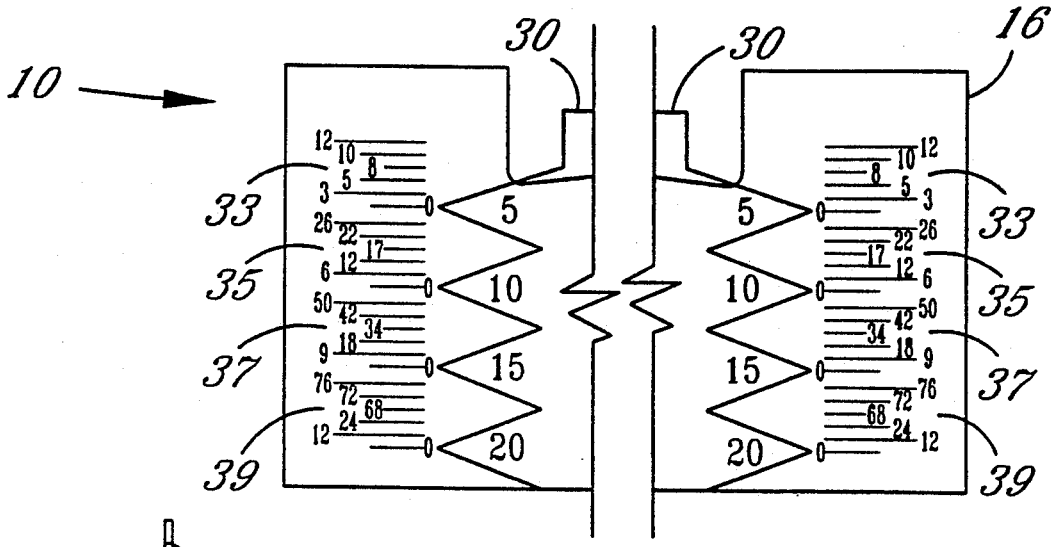
FIG. 3 is an exploded side sectional view showing the indica sections and pointing members.

A preferred embodiment of break gauge of the invention is best shown in FIGS. 1, 2 and 3. Gauge A which is preferably formed of clear plastic and consist of a base 10 which is substantially rectangularly configured at six and one half inches long and one and seven-eighth's inches high. Base 10 includes an upper edge 12, a lower edge 14 and opposed ends 16. Upper edge 12 is formed with a recessed or cutaway portion 18 arranged intermediate its extremities 20. The edge of cutaway portion 18 may be tapered downwardly from the center of base 10 toward said extremities 20 as clearly shown in the drawings. Lower edge 14 is provided with a cut out section in which a concave leveling element 22 is mounted. Leveling element 22 is the usual type of liquid filled cylinder with a bubble which is found in a carpenter's level and is well known.

Leveling element 22 includes a glass cylinder having spaced level lines 24. The cylinder is partially filled with liquid so as to form a bubble 26. When base 10 is held in a position which is perfectly transverse with true vertical, bubble 26 will locate between level lines 24 as shown in FIGS. 1 and 2. Should base 10 be slightly off 90 degrees of true vertical, bubble 26 will locate outside of lines 24.

Measure indicia 28 is arranged on one surface of base 10 adjacent each of ends 16. The indica is arranged in mirror fashion in sections 33, 35, 37, and 39 which are longitudinally spaced by approximately five inches as shown in the drawings. Each section is calibrated with five indicating lines which are vertically spaced by forty-two thousands of an inch. Each line denotes a different distance of break. Each section pair is calibrated for a different distance from the golf cup as will be described in more detail hereinafter.

A sighting element 30, which is approximately 5" in length is pivotally connected with base 10 by pin 32. The axis of rotation for base 10 and sighting element 30 is arranged at their center point. The opposite ends of sighting element 30 are provided with opposed pointing members 34, 36, 38 and 40, which are spaced from each other at their points by approximately three-eights of an inch. Each pair of point members, such as 34 is arranged along a single plane. As shown in the drawings, pointing members 34 are to be used when the golf ball is five feet from the golf cup. Pointing members 36 are to be used when the golf ball is ten feet from the golf cup, pointers 38 for fifteen feet and pointers 40 for twenty feet. Also, pointing members 34 are restricted for use with indica sections 33, pointing members 36 are restricted for use with indica sections 35, pointing members 38 are restricted for use with indica sections 37 and pointing members 40 are restricted for use with indica sections 39. The indica sections 33, 35, 37 and 39 are spaced from each other by one eighth of an inch.

Indica sections 33 each consist of six horizontal spaced parallel lines which are also parallel of edge 14. The lower most line is designated 0, the second line is designated 3, the third line is designated 5, the fourth line is designated 8, the fifth line is designated 10 and the sixth line is designated 12.

Each of these designations represents the number of inches a golf ball will break when putted at a proper speed from five feet from the golf cup.

Indica sections pairs 35, 37 and 39 consist of the same number of vertically spaced parallel lines as does section pair 33. The lines in section 35 are designated 0, 6, 12, 17, 22, and 26. The lines in section 37 are designated 0, 9, 18, 34, 42, and 52 and the lines in section 39 are designated 0, 12, 24, 68, 72, and 76.

As with indica section 33, the designations on indica sections 35, 37 and 39 represent the number of inches a golf ball will break between its point of initiation at 10, 15 and 20 feet respectively and the golf cup.

Figure 4:
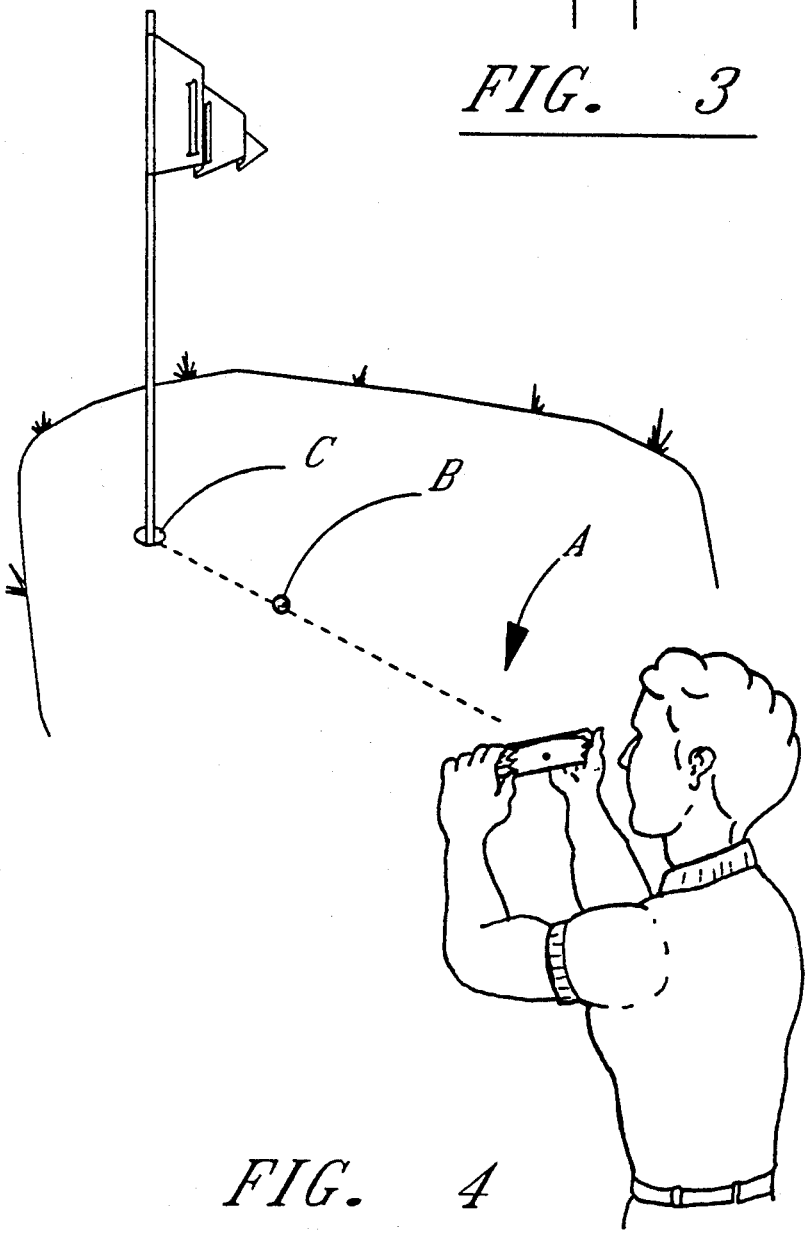
FIG. 4 is a perspective view of the gauge in use by a golfer.

In use, a golfer stands behind his golf ball facing the golf cup as shown in FIG. 4. The golfer determines the distance of the golf ball from the golf cup to be 5, 10, 15 or 20 feet. Assuming 5 feet is the position of the ball from the cup. The golfer levels base 10 of gauge A to be perpendicular to true vertical using level member 22. The golfer then sights over edge 42, over golf ball B and sights in at golf cup C. He then pivots sighting element 30 so that edge 42 and the surface of the putting green adjacent golf cup C are parallel. During this adjustment of sighting element 30, base 10 is kept perpendicular with true vertical. The adjustment of sighting element 30 will place either the left or right pointing member 34, depending on the direction of the slope of the surface of the green, on one of the lines of indica section 33. The line designation represents the number of inches the golf ball will break when properly putted. If the left pointing member 34 is used, the ball will break to the right and consequently must be putted toward a point the designated distance to the left of the golf cup. Should the right pointing member 34 indicate the break the above procedure is reversed.

Should the pointing member point between parallel lines, the two designations are totalled and then halved. Should the golf ball be forty feet from the golf cup. The amount is break is simply double the reading for 20 feet. Similar computations are necessary when the ball rest at 8 feet or some other distance between the designated yardage from the golf cup. Always, the lesser distance indica should be used and computations made from.

It should be noted that while specific sizes and measurements have been set forth such represent only the most preferred. It is well within the scope of the invention to alter the size and shape of the claimed gauge while still bringing about the desired function.

What is claimed is:

1. A putting gauge for determining the distance of break of a putted golf ball when putted from a given point on a surface of a golf green toward a golf cup at a proper speed, said gauge including;

an elongated base member having upper and lower edges and opposite ends each of which includes measuring indica;

an elongated sighting element pivotally mounted on said base member and having a sighting edge and opposite ends including pointing means alignable with said indicia;

a bubble level secured to said base member so that said base member may be held in a horizontal position transverse to true vertical and said sighting edge may be arranged in a position corresponding to the slope of said golf green surface at said golf cup and said pointing means points to said measuring indicia to indicate the distance a golf ball properly putted from a predetermined distance will break to the left or right of said golf cup.

2. The device of claim 1 wherein; said level is secured along said lower edge of said base.

3. The device of claim 1 wherein; said measure indicia is arranged in spaced segments along said opposed edges, each segment of said spaced indicia being correlated for a different distance from said golf cup.

4. The device of claim 3 wherein; said spaced segments adjacent a left end of said opposed ends of said base indicate the distance of break of said golf ball to the right and said spaced segments adjacent a right end of said opposed ends of said base indicate the distance of break of said golf ball to the left.

5. The device of claim 1 wherein; said pointing means are arranged as a plurality of opposed pairs of pointing elements arranged along opposite ends of said sighting element, each pair of said opposed pairs of pointing elements being correlated for a different distance from said golf cup.

6. The device of claim 5 wherein; there are four opposed pairs of said pointing elements with a first of said opposed pairs of pointing elements being correlated for a distance of five feet between said point and said golf cup and each successive pair of said opposed pairs of pointing elements being correlated for a greater distance.

7. The device of claim 5 wherein; said pointing elements arranged on a left end of said sighting element are operative to determine the break of said putted golf ball to the right and said pointing elements arranged on a right end of said sighting element are operative to determine the break of said putted golf ball to the left.

* * * * *